US009924813B1

(12) United States Patent
Basten et al.

(10) Patent No.: US 9,924,813 B1
(45) Date of Patent: Mar. 27, 2018

(54) BED SHEET SYSTEM

(71) Applicant: Select Comfort Corporation, Minneapolis, MN (US)

(72) Inventors: Jessica Basten, Plymouth, MN (US); Lori MacLachlan, Minneapolis, MN (US)

(73) Assignee: Sleep Number Corporation, Minneapolis, MN (US)

( * ) Notice: Subject to any disclaimer, the term of this patent is extended or adjusted under 35 U.S.C. 154(b) by 223 days.

(21) Appl. No.: 14/726,302

(22) Filed: May 29, 2015

(51) Int. Cl.
*A47G 9/02* (2006.01)
*A47G 9/04* (2006.01)

(52) U.S. Cl.
CPC ..... *A47G 9/04* (2013.01); *A47G 9/0223* (2013.01); *A47G 9/0238* (2013.01); *A47G 9/0246* (2013.01)

(58) Field of Classification Search
CPC ..... A47G 9/0238; A47G 9/0246; A47G 9/04
See application file for complete search history.

(56) References Cited

U.S. PATENT DOCUMENTS 1,742,064 A 12/1929 Dinstuhl
2,024,050 A * 12/1935 May ..... A47C 21/022 24/72.5
2,505,027 A 4/1950 Belsky
2,630,587 A 5/1953 Brown
2,662,234 A 12/1953 Citron
2,789,292 A 4/1957 Budinquest
3,179,958 A 4/1965 Carris
3,355,748 A 12/1967 Tuvert
4,344,196 A * 8/1982 Large ..... A47G 9/0246 5/496
4,658,454 A * 4/1987 Potter ..... A47G 9/02 5/497
4,766,628 A 8/1988 Greer et al.
4,788,729 A 12/1988 Greer et al.
4,825,489 A * 5/1989 Ross ..... A47C 27/005 5/497
4,829,616 A 5/1989 Walker
4,890,344 A 1/1990 Walker
4,897,890 A 2/1990 Walker
(Continued)

OTHER PUBLICATIONS

U.S. Appl. No. 14/687,633, filed Apr. 15, 2015, Brosnan et al.
(Continued)

*Primary Examiner* — Nicholas F Polito
*Assistant Examiner* — Rahib T Zaman
(74) *Attorney, Agent, or Firm* — Fish & Richardson P.C.

(57) ABSTRACT

A fitted sheet system can include a fitted sheet with top, head, foot, first side, and second side portions, such that the top portion is connected to each of the head portion, the foot portion, the first side portion, and the second side portion with the head portion positioned opposite the foot portion and the first side portion positioned opposite the second side portion so as to define a mattress receiving area. The system can include a breakaway strap system including a first breakaway strap extending from the first side portion to one of the head portion or the foot portion and configured to reconnectably detach in response to force pulling on the first breakaway strap. A sheet system can include the fitted sheet system and a second sheet having a fitted foot end and be configured to be attached to fasteners of the fitted sheet system.

20 Claims, 7 Drawing Sheets

(56) References Cited

U.S. PATENT DOCUMENTS 4,908,895 A 3/1990 Walker
4,991,244 A 2/1991 Walker
5,027,460 A * 7/1991 Honig ..... A47G 9/0246 5/482
5,099,531 A * 3/1992 Schmier ..... A47C 21/022 5/494
5,144,706 A 9/1992 Walker et al.
5,170,522 A 12/1992 Walker
5,189,744 A * 3/1993 Roberts ..... A47G 9/0246 5/497
5,208,926 A * 5/1993 Stackhouse ..... A47C 21/022 5/482
5,280,657 A * 1/1994 Stagg ..... A47G 9/04 5/496
5,509,154 A 4/1996 Shafer et al.
5,513,403 A * 5/1996 Wooten, Jr. ..... A47G 9/0246 112/418
5,564,140 A 10/1996 Shoenhair et al.
5,636,393 A * 6/1997 Zafiroglu ..... A47G 9/0246 428/102
5,642,546 A 6/1997 Shoenhair
5,652,484 A 7/1997 Shafer et al.
5,765,246 A 6/1998 Shoenhair
5,903,941 A 5/1999 Shafer et al.
5,904,172 A 5/1999 Gifft et al.
6,037,723 A 3/2000 Shafer et al.
6,098,219 A 8/2000 Milber
6,108,844 A 8/2000 Kraft et al.
6,134,730 A 10/2000 Evanson
6,161,231 A 12/2000 Kraft et al.
6,185,766 B1 * 2/2001 Farrugia ..... A47C 21/022 24/72.5
6,202,239 B1 3/2001 Ward et al.
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury
6,854,139 B2 * 2/2005 Lamy ..... A47G 9/02 5/482
6,883,191 B2 5/2005 Gaboury et al.
6,886,197 B1 5/2005 Madigan
7,316,039 B2 * 1/2008 Wootten, Jr. ..... A47G 9/0246 5/497
7,380,297 B2 * 6/2008 Bauer ..... A47G 9/0207 5/482
7,389,554 B1 6/2008 Rose
7,487,561 B2 * 2/2009 Ho ..... A47G 9/02 5/482
7,669,257 B2 3/2010 Swihart et al.
7,865,988 B2 1/2011 Koughan et al.
8,122,541 B1 * 2/2012 Georgatos ..... A47G 9/0238 5/494
8,282,452 B2 10/2012 Grigsby et al.
8,336,369 B2 12/2012 Mahoney
8,444,558 B2 5/2013 Young et al.
8,627,521 B2 1/2014 Rowson et al.
8,635,724 B2 1/2014 Moorhouse
8,672,853 B2 3/2014 Young
8,689,375 B2 4/2014 Stinchcomb
8,769,747 B2 7/2014 Mahoney et al.
8,856,984 B1 * 10/2014 Donham ..... A47G 9/0246 5/496
8,875,326 B1 * 11/2014 Bernath ..... A47G 9/0246 5/496
8,898,834 B1 * 12/2014 Huber ..... A47C 31/105 5/482
8,931,329 B2 1/2015 Mahoney et al.
8,950,024 B1 * 2/2015 Hudson ..... A47G 9/02 5/485
8,966,689 B2 3/2015 McGuire et al.
8,973,183 B1 3/2015 Palashewski et al.
8,984,687 B2 3/2015 Stusynski et al.
2004/0199999 A1 * 10/2004 Landry ..... A47D 15/008 5/494
2004/0221393 A1 11/2004 Stokes
2005/0138730 A1 * 6/2005 Henry ..... A47G 9/02 5/482
2008/0077020 A1 3/2008 Young et al.
2009/0113635 A1 * 5/2009 Robinson ..... A47C 31/105 5/692
2009/0178197 A1 * 7/2009 Swihart ..... A47G 9/02 5/496
2009/0205134 A1 * 8/2009 Wootten, Jr. ..... A47G 9/0246 5/488
2011/0144455 A1 6/2011 Young et al.
2012/0186012 A1 * 7/2012 Ponsi ..... A61G 7/001 5/81.1 R
2012/0186013 A1 * 7/2012 Ponsi ..... A61G 7/001 5/81.1 R
2012/0186587 A1 * 7/2012 Steffens ..... A61G 7/001 128/845
2012/0227183 A1 * 9/2012 Muskelly ..... A47G 9/007 5/487
2013/0117933 A1 5/2013 Mickle et al.
2013/0205495 A1 * 8/2013 Ponsi ..... A61G 7/001 5/81.1 HS
2014/0013510 A1 * 1/2014 Mcaleney ..... A47G 9/0246 5/496
2014/0115781 A1 5/2014 John
2014/0182061 A1 7/2014 Zaiss
2014/0189952 A1 * 7/2014 Crispino ..... A47G 9/02 5/482
2014/0250597 A1 9/2014 Chen et al.
2014/0257571 A1 9/2014 Chen et al.
2014/0259417 A1 9/2014 Nunn et al.
2014/0259418 A1 9/2014 Nunn et al.
2014/0259431 A1 9/2014 Fleury
2014/0259433 A1 9/2014 Nunn et al.
2014/0259434 A1 9/2014 Nunn et al.
2014/0277611 A1 9/2014 Nunn et al.
2014/0277778 A1 9/2014 Nunn et al.
2014/0277822 A1 9/2014 Nunn et al.
2015/0007393 A1 1/2015 Palashewski
2015/0025327 A1 1/2015 Young et al.
2015/0026896 A1 1/2015 Fleury et al.
2015/0157137 A1 6/2015 Nunn et al.
2015/0157519 A1 6/2015 Stusynski et al.
2015/0182033 A1 7/2015 Brosnan et al.
2015/0182397 A1 7/2015 Palashewski et al.
2015/0182399 A1 7/2015 Palashewski et al.
2015/0182418 A1 7/2015 Zaiss

OTHER PUBLICATIONS

U.S. Appl. No. 14/675,355, filed Mar. 31, 2015, Palashewski et al.
U.S. Appl. No. 14/283,675, filed May 21, 2014, Mahoney et al.
Bed sheet, publicly available for sale prior to May 29, 2015, 1 page.

* cited by examiner

BED SHEET SYSTEM

TECHNICAL FIELD

This invention relates to bedding, and more particularly to sheets for use on a bed.

BACKGROUND

Use of bedding can vary by user preferences, but often includes pillows, pillow cases, sheets, blankets, comforters and similar items. In some cases, a user will use a fitted sheet for covering a mattress, a second top sheet to go on top of the fitted sheet, and a blanket to go on top of the fitted sheet for warmth.

SUMMARY

Some embodiments of bed sheet systems can include one or more of the features and functions disclosed herein. Some embodiments can include a fitted sheet system with one or more straps breakaway straps that are configured to reconnectably detach in response to force pulling on the second breakaway strap to reduce the risk of entanglement of children or other users. The sheet system can include fasteners, such as buttons and button slits for inter-connecting sheets as a system. The sheet system can include multiple sheets, each having at least a portion of the respective sheet being fitted along the mattress. A second, top sheet can have a fitted foot end and also have connectors for connecting the second sheet to a fitted sheet, which can help retain the fitted foot end in place. The sheet system can facilitate children or adults making the bed and can facilitate sheets staying in place in a comfortable way during sleep for children or adults. The sheet system can improve the daily task of making the bed to achieve a more attractive and repeatable result—especially when the bed is made by children. Implementations can include any, all, or none of the following features.

In one aspect, a fitted sheet system for use on a bed can include a fitted sheet including a top portion, a head portion, foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area. The system further includes a breakaway strap system includes a first breakaway strap extending from the first side portion to one of the head portion or the foot portion and configured to reconnectably detach in response to force pulling on the first breakaway strap.

Implementations can include any, all, or none of the following features. The first breakaway strap extends to the head portion. The breakaway strap system further includes a second breakaway strap extending from the second side portion to the head portion and configured to reconnectably detach in response to force pulling on the second breakaway strap, a third breakaway strap extending from the first side portion to the foot portion and configured to reconnectably detach in response to force pulling on the third breakaway strap, and a fourth breakaway strap extending from the second side portion to the foot portion and configured to reconnectably detach in response to force pulling on the second breakaway strap. The first and second breakaway straps connected to the head portion are longer than the third and fourth breakaway straps connected to the foot portion and each of the first, second, third, and fourth breakaway straps detach at locations proximate one of the first and second side portions. The first breakaway strap includes a first length of elastic material extending from the head portion to a first fastener, the second breakaway strap includes a second length of elastic material extending from the head portion to a second fastener, the third breakaway strap includes a third length of elastic material extending from the foot portion to a third fastener, and the fourth breakaway strap includes a fourth length of elastic material extending from the foot portion to a fourth fastener. The first breakaway strap includes a first length of twill material extending from the first side portion to the first fastener, the second breakaway strap includes a second length of twill material extending from the second side portion to the second fastener, the third breakaway strap includes a third length of twill material extending from the first side portion to the third fastener, and the fourth breakaway strap includes a fourth length of twill material extending from the second side portion to the fourth fastener. The first breakaway strap includes a reconnectable snap that detaches in response to a tensile force being applied to the first breakaway strap exceeding a first threshold and that does not detach in response to a tensile force being applied to the first breakaway strap that is less that the first threshold. The first breakaway strap includes a first length of elastic material reconnectably attached to a second length of substantially non-elastic material. The first length of elastic material has a first end connected to the head portion and a second end connected to a first fastener, wherein the second length of substantially non-elastic material is connected to the first side portion and to a second fastener configured to releasably mate with the first fastener, and wherein the first length of elastic material is longer than the second length of substantially non-elastic material. The fitted sheet system including at least one first button connected to a first reinforced section of the first side portion by a first elastic material at a first location of the first side portion spaced from a first edge of the first side portion and at least one second button connected to a second reinforced section of the second side portion by a second elastic material at a second location of the second side portion spaced from a second edge of the second side portion.

In one aspect, a sheet system can include the fitted sheet system described above which further includes a plurality of fasteners with at least one fastener positioned on each of the first and second side portions of the fitted sheet. The system can further include a second sheet having a head end, a foot end, a first side edge, and a second side edge. The foot end is a fitted end configured to be fitted along a mattress and the head end is an opened end The second sheet is configured to be attached to the plurality of fasteners.

Implementations can include any, all, or none of the following features. The second sheet includes elastic material extending along a portion of the first side edge near the foot end, along a portion of the second side edge near the foot end, and along a foot edge. The second sheet includes substantially no elastic material extending along a portion of the first side edge near the head end, along a portion of the second side edge near the head end, and along a head edge. The second sheet includes reinforced button-receiving slits positioned near the first and second side edges. The plurality of fasteners include a first plurality of buttons connected to first reinforced sections of the first side portion by a first plurality of elastic materials at locations of the first side portion spaced from a first edge of the first side portion and a second plurality of buttons connected to second reinforced sections of the second side portion by a second plurality of elastic materials at locations of the second side portion spaced from a second edge of the second side portion. The reinforced button-receiving slits include a first reinforced button-receiving slit near the first side edge positioned between 50.57 and 51.07 inches from a second reinforced button-receiving slit near the second side edge, and a third reinforced button-receiving slit near the first side edge positioned between 50.57 and 51.07 inches from a fourth reinforced button-receiving slit near the second side edge. The fitted sheet has fitted elastic material around its entire edge including the head portion, the first side portion, the foot portion, and the second side portion, and wherein the second sheet has fitted elastic material along a fitted edge of the foot end of the second sheet. The fitted sheet system has dimensions defined by one of Embodiments 1, 2, or 3 of Table 1 as listed in the specification and the second sheet has dimensions defined by one of Embodiments 1, 2, or 3 of Table 2 as listed in the specification.

In one aspect, a sheet system includes a fitted sheet including a top portion, a head portion, foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area. The system further includes a strap system including a plurality of straps extending from the first and second side portions to the head portion. The system further includes at least one first fastener connected to a first reinforced section of the first side portion by a first elastic material at a first location of the first side portion spaced from a first edge of the first side portion. The system further includes at least one second fastener connected to a second reinforced section of the second side portion by a second of elastic material at a second location of the second side portion spaced from a second edge of the second side portion. The system further includes a second sheet having a head end, a foot end, a first side edge, and a second side edge. The foot end is a fitted end configured to be fitted along a mattress and the head end is an opened end and wherein the second sheet is configured to be attached to the first and second fasteners.

Implementations can include any, all, or none of the following features. The sheet system including a blanket having a blanket head end, a blanket foot end, a blanket first side edge, and a blanket second side edge, wherein blanket is configured to be attached to the first and second fasteners. The first fastener includes a first button connected to the first reinforced section of the first side portion by the first elastic material extending from the first side portion to the first button and the second fastener includes a second button connected to the second reinforced section of the second side portion by the second elastic material extending from the second side portion to the second button. One of the plurality of straps of the strap system is configured to reconnectably detach in response to a force exceeding a threshold when a user becomes entangled in the one of the plurality of straps.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
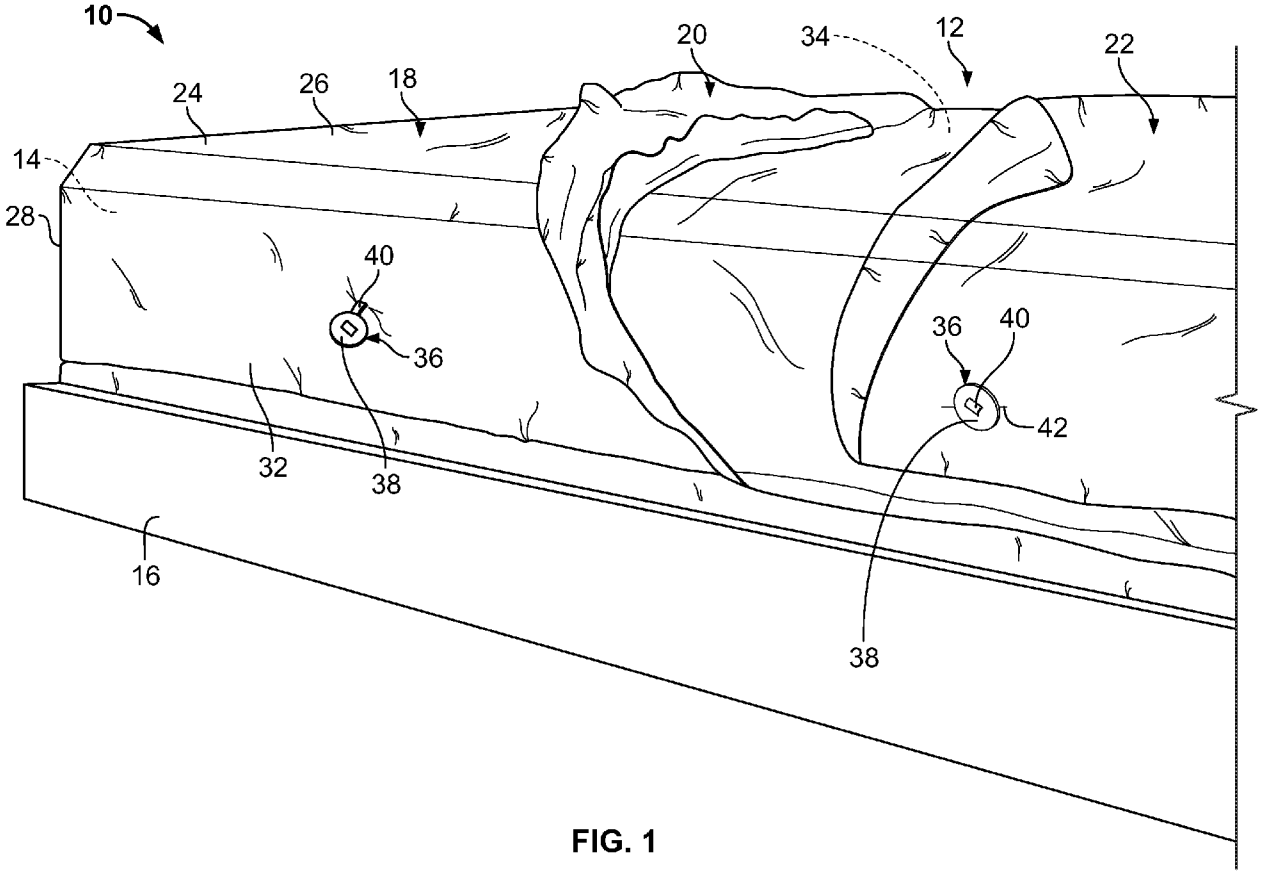
FIG. 1 is a perspective view of a bed system having a sheet system.

FIG. 1 is a perspective view of a bed system 10 having a sheet system 12, a mattress 14, and a foundation 16. In some embodiments, the mattress 14 can include one or more support materials, such as one or more air chambers, foam materials, and/or springs (not shown). In some embodiments, the foundation 16 can include one or more supporting structures, such as stationary support structures and/or actuating support structures. In alternative embodiments, the mattress 14 and the foundation 16 can be configured differently than as illustrated.

The sheet system 12 can include a fitted sheet system 18, a second sheet 20, and a blanket 22. The fitted sheet system 18 includes a fitted sheet 24 that can be fitted along the mattress 14. The second sheet 20 (also called a top sheet) can be positioned on top of the fitted sheet 24. The blanket 22 can be positioned on top of the second sheet 20 and/or the fitted sheet 24.

The fitted sheet 24 includes a top portion 26, a head portion 28, a foot portion 30 (shown in FIG. 3), a first side portion 32, and a second side portion 34. The top portion 26 is connected to each of the head portion 28, the foot portion 30, the first side portion 32, and the second side portion 34 with the head portion 28 positioned opposite the foot portion 30 and the first side portion 32 positioned opposite the second side portion 34 so as to define a mattress receiving area that is fitted along the mattress 14. The top portion 28 can be sewn to each of the first and second side portions 32 and 34 and the bottom portion 30 can be sewn to each of the first and second side portions 32 and 34 to form seams.

The fitted sheet system 18 can include button systems 36, each including a button 38 and a strap 40. The strap 40 can be a length of elastic material extending from the side portions 32 and 34 of the fitted sheet 24 to the buttons 38 to support the button 38 at a position spaced from the fitted sheet 24.

The second sheet 20 and the blanket 22 can each include connectors, such as button-receiving slits 42 (also called button-receiving holes or button holes) for receiving the buttons 38 and the straps 40 therethrough. The button systems 36 can function together with the button-receiving slits 42 to hold the blanket 22 and the second sheet 20 to the fitted sheet system 18 such that the blanket 22, the second sheet 20, and the fitted sheet system 18 function together as a common sheet system 12. The fitted sheet system 18 can hold the blanket 22 and the second sheet 20 in-place on the mattress 14 by virtue of the button system 36. The second sheet 20 can be a top sheet to be positioned on top of the fitted sheet 24. The blanked 22 can be positioned on top of the second sheet 20. The button system 36 can be an impermanent attachment mechanism, allowing the fitted sheet system 18, the second sheet 20, and/or the blanket 22 to be attached, detached, and attached again.

Figure 2:
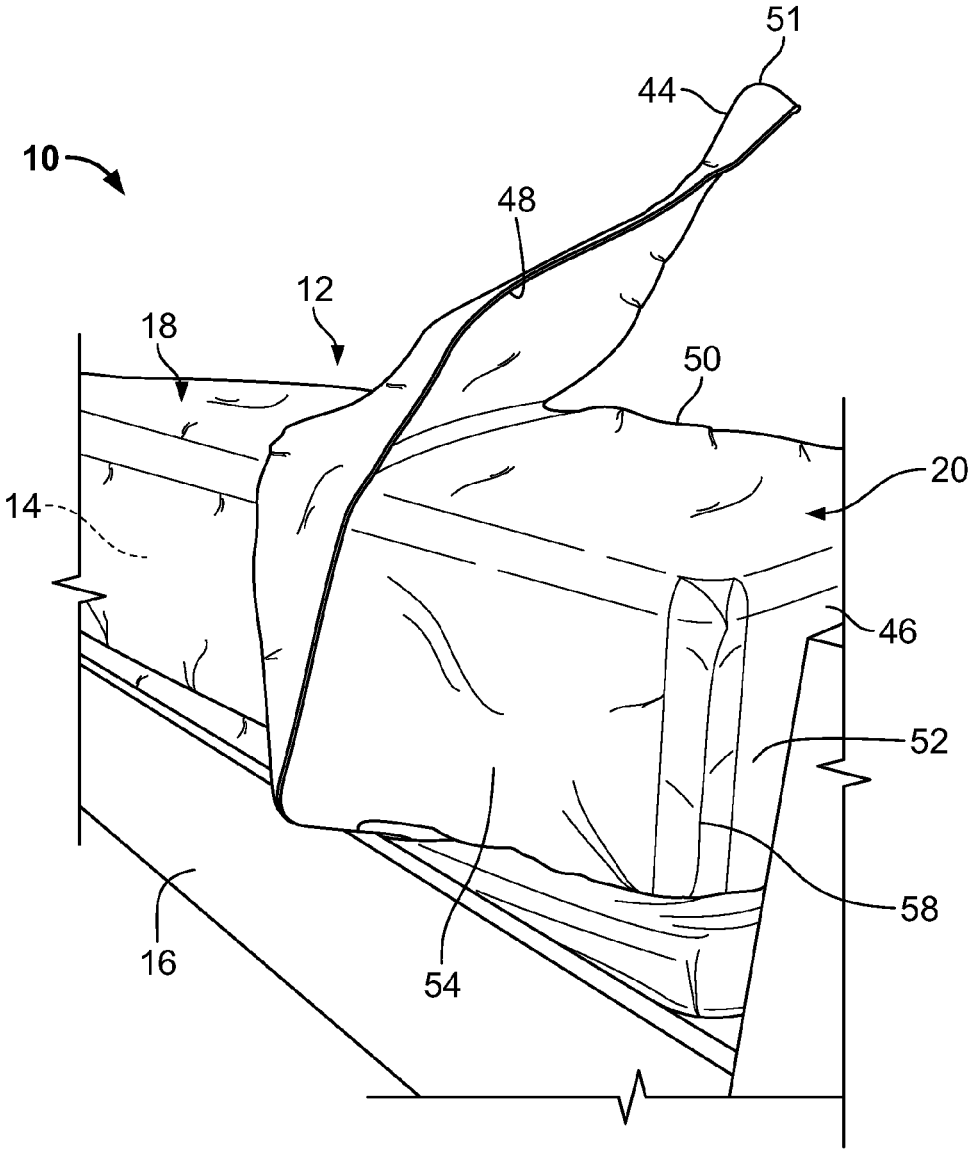
FIG. 2 is a perspective view of the bed system and sheet system of FIG. 1.

FIG. 2 is a perspective view of the bed system 10 the sheet system 12. As shown in FIG. 2, the second sheet 20 can have a head end 44, a foot end 46 opposite the head end 44, a first side edge 48, and a second side edge 50 opposite the first side edge 48. The foot end 46 is a fitted end configured to be fitted along a foot of the mattress 14 and the head end 44 is an opened end. In some embodiments, the head end 44 can have a substantially straight head edge 51. The foot end 46 can include a foot portion 52, a first side portion 54, and a second side portion 56 (shown in FIGS. 8 and 9). The foot portion 52 can be sewn to the first and second side portions 54 and 56 at seams 58 to form a fitted portion at the foot end 46. In such embodiments, the second sheet 20 can be fitted along the mattress 14 at the foot end 46 and be open at the head end 44 to allow a user to enter and exit from under the second sheet 20 at the head end 44.

In some embodiments, the second sheet 20 can also be configured to be attached to a plurality of fasteners. For example, the second sheet 20 can include one or more slits 42 (shown in FIG. 1) for connecting to the button systems 36 (shown in FIG. 1) of the fitted sheet system 18. In such embodiments, the second sheet 20 can be fitted along the mattress 14 at the foot end 46, can be attached along or near its first and second side edges 48 and 50, and can be open at the head end 44 to allow a user to enter and exit from under the second sheet 20 at the head end 44. In some embodiments, the button systems 36 can remain connected to the second sheet 20 while the user is sleeping under the second sheet 20 to keep the user held relatively tight under the second sheet 20. In some embodiments, the button system 36 can be connected when making the bed, but can be detached and remain unconnected when the user is sleeping under the second sheet 20.

Figure 3:
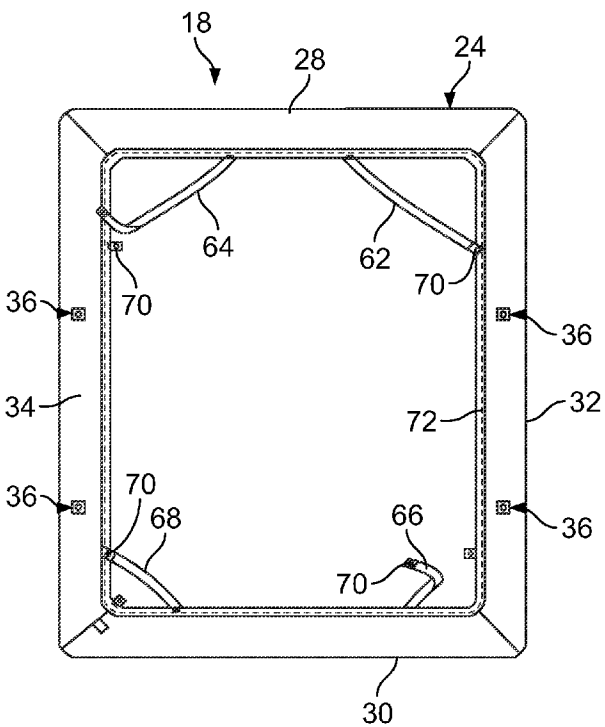
FIG. 3 is a bottom view of a fitted sheet system of the sheet system of FIG. 1.

FIG. 3 is a bottom view of the fitted sheet system 18 of the sheet system 12. FIG. 3 shows the fitted sheet system 18 having a strap system 60, which can be a breakaway strap system having a plurality of breakaway straps configured to break when subjected to a force exceeding a threshold force. In some embodiments, the threshold force can be a threshold force of pulling on one of the breakaway straps of the strap system 60 in tension of between about 17 pounds and about 25 pounds. In some embodiments, the threshold force can be a force pulling in tension of between about 19 pounds and about 23 pounds. In some embodiments, the threshold force can be a force pulling in tension of about 21 pounds.

In some embodiments, the strap system 60 can include one or more breakaway straps (also called bands), such as strap 62, extending diagonally from the first side portion 32 to one of the head portion 28 or the foot portion 30 and configured to reconnectably detach in response to force pulling on the strap 62. In the illustrated embodiment, the strap 62 extends from the first side portion 32 to the head portion 28. In the illustrated embodiment, the strap system 60 also includes straps 64, 66, and 68. Strap 64 extends from the second side portion 34 to the head portion 28 and is configured to reconnectably detach in response to force pulling on the strap 64. The strap 66 extends from the first side portion 32 to the foot portion 30 and is configured to reconnectably detach in response to force pulling on the strap 66. The strap 68 extends from the second side portion 34 to the foot portion 30 and is configured to reconnectably detach in response to force pulling on the strap 68. The straps 62, 64, 66, and 68 can each have connectors 70 that are detachable and reconnectable to allow the straps 62, 64, 66, and 68 to function as breakaway straps and reconnect for repeated use. In some embodiments, the connectors 70 can be a reconnectable snap, with male and female connector portions on separate lengths of the straps 62, 64, 66, and 68. As shown in FIG. 3, straps 62 and 68 are shown as connected (or attached) and straps 64 and 66 are shown as disconnected (or detached).

In some embodiments, the connectors 70 of the strap system 60 can detach in response to force pulling in tension in excess of the thresholds described above. In some embodiments, the connectors 70 can be configured such that the connectors 70 detach if the threshold force is exceed for about 10 seconds or more. In some embodiments, the threshold force can be a lifting force on one of the connectors 70 of between about 3 pounds and about 5 pounds. In some embodiments, the threshold force can be a lifting force on one of the connectors 70 of about 4 pounds.

The fitted sheet 24 can include a rim 72 defined by bottom edges of each of the head portion 28, the foot portion 30, the first side portion 32, and the second side portion 34. In some embodiments, the rim 72 can be a reinforced rim that is reinforced by one or more layers of fabric or other reinforcing material. In some embodiments, the rim can include elastic extending around substantially all of the rim 72. In some embodiments, the rim 72 can include elastic extending around much but not all of the rim 72. The straps 62, 64, 66, and 68 can connect to and extend away from the rim 72.

The fitted sheet system 18 can include a plurality of button systems 36. In various embodiments, the number of button systems 36 used on the fitted sheet system 36 can be greater or fewer than the number illustrated in FIG. 3. In the illustrated embodiment, two button systems 36 are included on the first side portion 32 and two more button systems 36 are included on the second side portion 34. In some embodiments, two button systems 36 is a suitable number for each side of the fitted sheet system 18 because it can be enough button systems to hold the second sheet 20 in position but not so many buttons systems 36 so as to create a cumbersome operation of attaching the second sheet 20 to the fitted sheet system 18.

Figure 4:
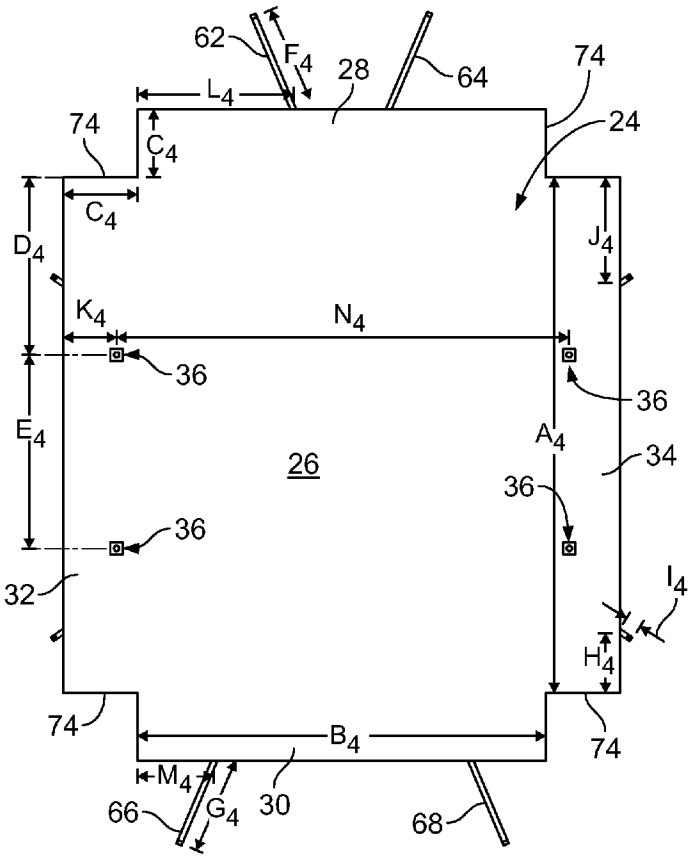
FIG. 4 is a top view of the fitted sheet system of FIG. 3.

FIG. 4 is a top view of the fitted sheet system 18 shown in a partially assembled state. As shown in FIG. 4, the straps 62, 64, 66, and 68 are shown detached and the fitted sheet 24 is shown with the rim 72 and seams 74 not yet sewn. The fitted sheet system 18 can be sized such that, in some embodiments, it is configured to be interconnected with and fit suitably with one or both of the second sheet 20 and the blanket 22 as further explained herein. In some embodiments, suitable sizes for various features of the fitted sheet system 18 are described in TABLE 1, below. Corresponding dimensions are illustrated with respect to reference characters $A_4$-$N_4$ in FIG. 4.

TABLE 1

| REF NO. | DESCRIPTION | Embodiment 1 (inches) | Embodiment 2 (inches) | Embodiment 3 (inches) |
|---|---|---|---|---|
| $A_4$ | length | 78 +/− ½" | 78 +/− ½" | 83.2 +/− ½" |
| $B_4$ | width | 39.52 +/− ½" | 56.16 +/− ½" | 62.4 +/− ½" |
| $C_4$ | pocket depth | 12.48 +/− ¼" | 12.48 +/− ¼" | 12.48 +/− ¼" |

TABLE 1-continued

| REF NO. | DESCRIPTION | Embodiment 1 (inches) | Embodiment 2 (inches) | Embodiment 3 (inches) |
|---|---|---|---|---|
| $D_4$ | center of button from top | 21.84 +/− ¼" | 21.84 +/− ¼" | 21.84 +/− ¼" |
| $E_4$ | length: button to button | 26 +/− ¼" | 26 +/− ¼" | 26 +/− ¼" |
| $F_4$ | top elastic length finished | 15 +/− ¼" | 15 +/− ¼" | 15 +/− ¼" |
| $G_4$ | bottom elastic length finished | 9 +/− ¼" | 9 +/− ¼" | 9 +/− ¼" |
| $H_4$ | bottom tab distance from bottom seam | 10.4 +/− ¼" | 10.4 +/− ¼" | 10.4 +/− ¼" |
| $I_4$ | tab length with male snap | 1.25 +/− ¼" | 1.25 +/− ¼" | 1.25 +/− ¼" |
| $J_4$ | center of tab from top seam | 17.68 +/− ¼" | 17.68 +/− ¼" | 17.68 +/− ¼" |
| $K_4$ | center of button from side edges | 8.32 +/− ¼" | 8.32 +/− ¼" | 8.32 +/− ¼" |
| $L_4$ | top elastic distance from seam | 16.64 +/− ¼" | 16.64 +/− ¼" | 16.64 +/− ¼" |
| $M_4$ | bottom elastic distance from seam | 10.4 +/− ¼" | 10.4 +/− ¼" | 10.4 +/− ¼" |
| $N_4$ | width: button to button | 47.84 +/− ¼" | 64.48 +/− ¼" | 70.72 +/− ¼" |

Figure 6:
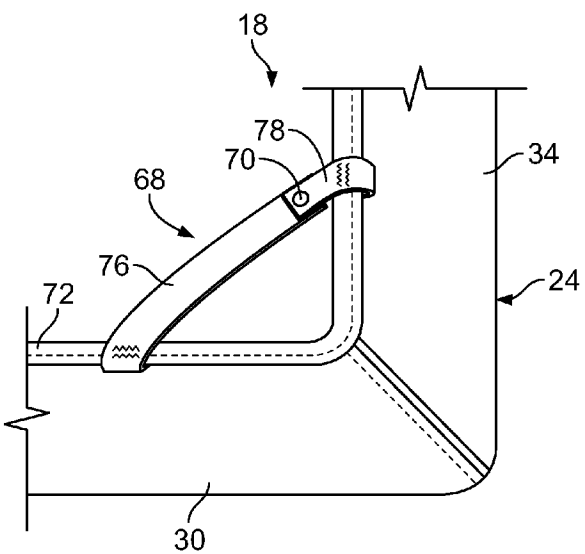
FIGS. 5 and 6 are inside and outside views of portions of the fitted sheet system of FIG. 3.
Figure 5:
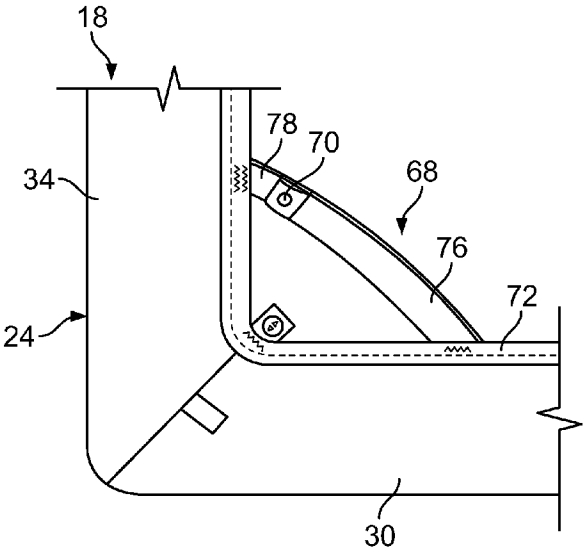

FIGS. 5 and 6 are views of portions of the fitted sheet system 18. FIG. 5 shows an enlarged view of the strap 68 and a corner of the fitted sheet 24 from the outside, as if looking from the same view as in FIG. 3, but enlarged. FIG. 6 shows an enlarged view of the strap 68 and a corner of the fitted sheet 24 from the inside, as if looking from inside the mattress receiving area defined by the fitted sheet 24.

In some embodiments, the strap 68 can include first and second lengths 76 and 78 connected by the connector 70. The first length 76 can be connected to and extend from the foot portion 30 and the second length 78 can be connected to and extend from the second side portion 34. In some embodiments, the lengths 76 and 78 can be sewn to the foot portion 30 and the second side portion 34, respectively, at the rim 72. The lengths 76 and 78 can include male and female snap connector portions at their respective distal ends for reconnectably detaching from each-other when force exceeds a threshold.

In some embodiments, the strap 68 can include an elastic material. For example, in some embodiments, the first length 76 can include a length of elastic material (such as a 1-inch width knit elastic material) and the second length 78 can be a length of twill material (such as a 1-inch width twill tape) shorter than the first length 76. The second length 78 can be twill or another substantially non-elastic material so as to provide a relatively stable and strong base for snap-connecting the first length 76. The first length 76 can be elastic so as to allow for stretching and improved fit of the fitted sheet system 18. In some embodiments, the first length 76 can be a 1 inch knit elastic material.

The strap 68 can be configured with the first length 76 being longer than the second length 78 so as to position the connector 70 nearer the side portion 34 (or the side portion 32 in the case of the straps 62 and 66) so as to facilitate ease of access of a user to the connector from the side of the mattress 14 (shown in FIGS. 1 and 2).

The strap 68 can be a breakaway strap and the strap system 60 can be a breakaway strap system so as to reduce the risk of entanglement of children or other users. The connectors 70 can be configured to break (or detach) at a force such that a user can detach the connector to reduce or avoid the risk of entanglement. In some applications, a user could detach the connector 70 to release his or her self from the strap 68. In some applications, a user could detach the connector 70 to release another from the strap 68, such as a parent releasing a child. In some applications, the connector 70 could release automatically when a user becomes entangled in the strap 68 if force exceeds a threshold. After the connector 70 is detached, the connector 70 can be reattached and the strap 68 can be used again as normal.

Length of the straps 62, 64, 66, and 68 of the strap system 60 can also be reduced to further reduce risk of entanglement. In some embodiments, length of the straps 62, 64, 66, and 68 can be as indicated in Table 1. In some embodiments, length of the straps 62, 64, 66, and 68 can be between about 9 inches and about 15 inches when not stretched. In some embodiments in which the straps 62, 64, 66, and 68 include elastic material, length of the straps 62, 64, 66, and 68 can be less than 30 inches when stretched to a maximum length. The location of the straps 62, 64, 66, and 68, with the length of the straps 62, 64, 66, and 68, with the breakaway feature of the straps 62, 64, 66, and 68 can combine to facilitate convenience and safety of the strap system 60.

Figure 7:
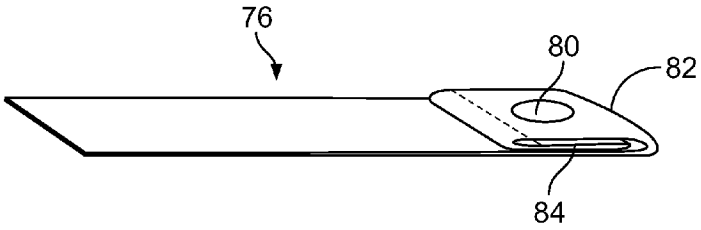
FIG. 7 is a perspective view of a portion of a strap for use in the fitted sheet system of FIG. 3.

FIG. 7 is a perspective view of the first length 76 of the strap 68 for use in the fitted sheet system 18. FIG. 7 shows the first length 76 having a female snap connector portion 80 at a distal end 82 of the first length 76. The first length 76 also has a plurality of folds of elastic material 84 to reinforce the first length 76 at the point of connection of the female snap connector portion 80.

Figure 8:
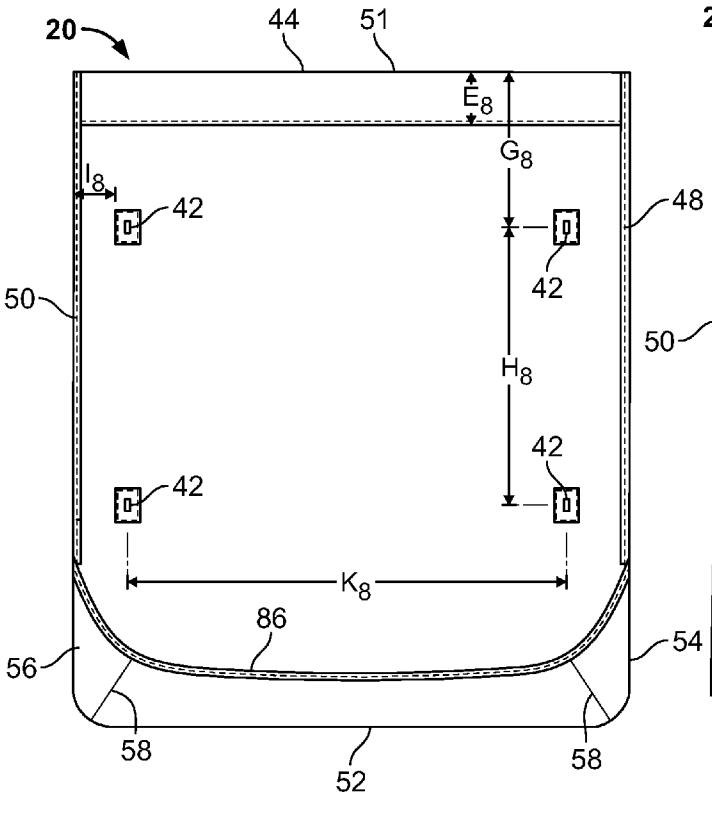
FIG. 8 is a bottom view of a second sheet of the sheet system of FIG. 1.

FIG. 8 is a bottom view of the second sheet 20. As shown in FIG. 8, the second sheet 20 can have an open head end 44 and a fitted foot end 46. In some embodiments, the second sheet 20 can include elastic material 86 extending along a portion of an edge of the first side portion 54 near the foot end 46, along a portion of an edge of the second side portion 56 near the foot end 46, and along an edge of the foot end 46. In some embodiments, the second sheet 20 can include substantially no elastic material extending along a portion of the first side edge 48 near the head end 44, along a portion of the second side edge 50 near the head end 44, and along a head edge 51. In some embodiments, the button-receiving slits 42 of the second sheet 20 can be reinforced button-receiving slits positioned near but spaced from the first and second side edges 48 and 50. The button-receiving slits 42 can be configured and positioned for connection to the button systems 36 of the fitted sheet system 18 (shown in FIGS. 1-4).

Accordingly, in some embodiments, not only is the fitted sheet 24 (shown in FIGS. 1-4) fitted along the mattress 14 (shown in FIGS. 1-2) but the second sheet 20 also includes a portion at the fitted foot end 46 that is fitted along the mattress 14. Thus, the sheet system 12 can include two sheets, each with at least a portion of the respective sheet being fitted along a mattress.

In some embodiments, the second sheet 20 includes the button-receiving slits 42 (or other sheet fasteners) for fastening to the sides of the fitted sheet system 18 in addition to the fitted foot end 46. The button-receiving slits 42 can function together in conjunction with the fitted foot end 46 to retain the second sheet 20 in place. The straps 62, 64, 66, and 68 can help retain the fitted sheet system 18 to the mattress 14. The fitted foot end 46 can help retain the fitted foot end 46 of the second sheet 20 to the mattress 14. Although the second sheet 20 could have a tendency to slide down toward the foot of the mattress 14, allowing the second sheet 20 and the fitted foot end 46 to fall off the foot of the mattress 14, the interaction of the button-receiving slits 42 with the button systems 36 of the fitted sheet system 36 can help retain the fitted foot end 46 in-place, and thus retain the second sheet 20 in-place. Accordingly, features of the fitted sheet system 18 and the second sheet system 20 can function as a system to improve a user's experience.

Figure 9:
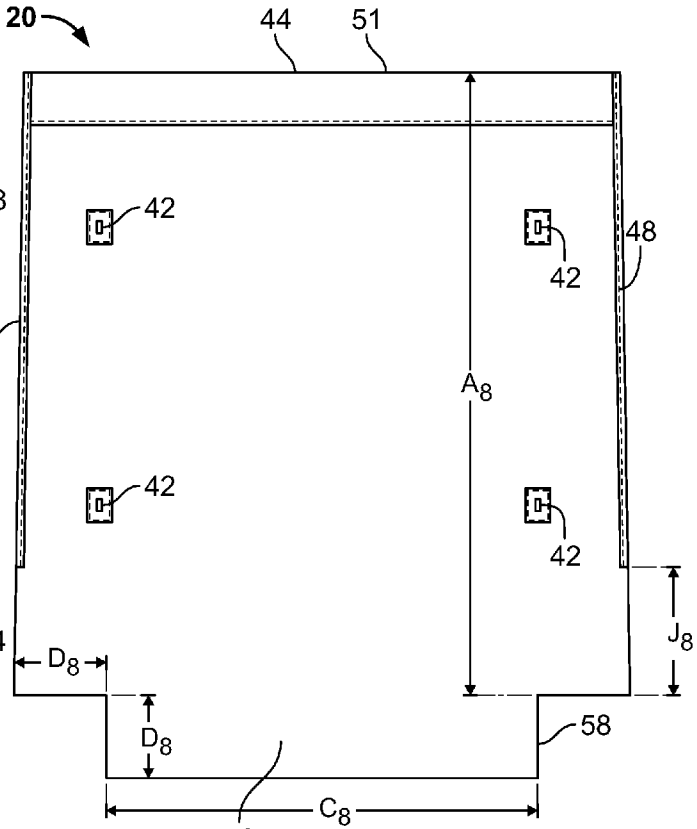
FIG. 9 is a top view of the second sheet of FIG. 8.

FIG. 9 is a top view of the second sheet 20 shown in a partially assembled state. As shown in FIG. 9, the second sheet 20 is shown with the seams 58 not yet sewn and the elastic material 86 (shown in FIG. 8) not yet attached.

The second sheet 20 can be sized such that, in some embodiments, it is configured to be interconnected with and fit suitably with the fitted sheet system 18 as further explained herein. In some embodiments, suitable sizes for various features of the second sheet 20 are described in TABLE 2, below. Corresponding dimensions are illustrated with respect to reference characters $A_8$-$K_8$ in FIGS. 8 and 9.

TABLE 2

| REF NO. | DESCRIPTION | Embodiment 1 (inches) | Embodiment 2 (inches) | Embodiment 3 (inches) |
|---|---|---|---|---|
| $A_8$ | length | 80.08 +/− ½" | 80.08 +/− ½" | 85.28 +/− ½" |
| $B_8$ | width at top | 60.32 +/− ½" | 76.96 +/− ½" | 83.2 +/− ½" |
| $C_8$ | width at bottom | 39.52 | 56.16 +/− ½" | 62.4 +/− ½" |
| $D_8$ | pocket depth | 10.4 +/− ¼" | 10.4 +/− ¼" | 10.4 +/− ¼" |
| $E_8$ | top hem | 4 +/− ¼" | 4 +/− ¼" | 4 +/− ¼" |
| $F_8$ | side hem | 0.5 +/− ⅛" | 0.5 +/− ⅛" | 0.5 +/− ⅛" |
| $G_8$ | top of sheet to center of buttonhole | 21.84 +/− ¼" | 21.84 +/− ¼" | 21.84 +/− ¼" |
| $H_8$ | center of buttonhole to center of buttonhole | 26 +/− ¼" | 26 +/− ¼" | 26 +/− ¼" |
| $I_8$ | side edge of sheet to bottom of reinforcement | 4 +/− ¼" | 4 +/− ¼" | 4 +/− ¼" |
| $J_8$ | elastic stop from seam | 10 +/− ¼" | 10 +/− ¼" | 10 +/− ¼" |
| $K_8$ | width: center of buttonhole to center of buttonhole | 50.82 +/− ¼" | 67.46 +/− ¼" | 73.70 +/− ¼" |

In some embodiments, the second sheet 20 can be sized with one, some, or all of the dimensions listed in an embodiment listed in Table 2. In some embodiments, the second sheet 20 can be sized with one, some, or all of the dimensions listed in an embodiment listed in Table 2 and the fitted sheet system 18 can be sized with one, some, or all of the dimensions listed in an embodiment listed in Table 1. In embodiments where the second sheet 20 and the fitted sheet system 18 act together as the sheet system 12, using one or more sizes from Tables 1 and 2 can facilitate the fitted sheet system 18 and the second sheet 20 suitably functioning together as a system for an improved user experience. For example, in some embodiments the sheet system 12 can function such that a user can sleep under the second sheet 20 when the second sheet 20 is buttoned to the fitted sheet system 18. In such embodiments, $K_8$ can be sized to allow a user comfortable space under the second sheet 20 (i.e. space so as to be not too tight and not too loose) when the second sheet 20 is buttoned to the fitted sheet system 18. Because the fitted sheet system 18 and the second sheet 20 function together as a system, the length of the straps 40 as well as the ability of materials to stretch can be factors in the design. For example, in embodiments where the straps 40 and straps 62, 64, 66, and 68 include elastic material, the straps 40 and straps 62, 64, 66, and 68 can stretch when a user is in bed, which can affect suitable dimensions for $K_8$ and for other features of the fitted sheet system 18 and the second sheet 20.

In some embodiments, the sheet system 12 can be configured for use with children's beds. For example, in some embodiments the sheet system 12 can be configured to facilitate children making their beds. In some embodiments, the sheet system 12 can be configured to facilitate children making their beds, with sheets being buttoned in place during the bed making process. In some embodiments, the sheet system 12 can be configured for children sleeping in bed, with the sheets staying in place in a comfortable way during sleep. In some embodiments, the sheet system 12 can be configured both for children making their beds and for children sleeping in their beds. In some embodiments, the sheet system 12 can also be configured for making and sleeping in adult beds.

Figure 11:
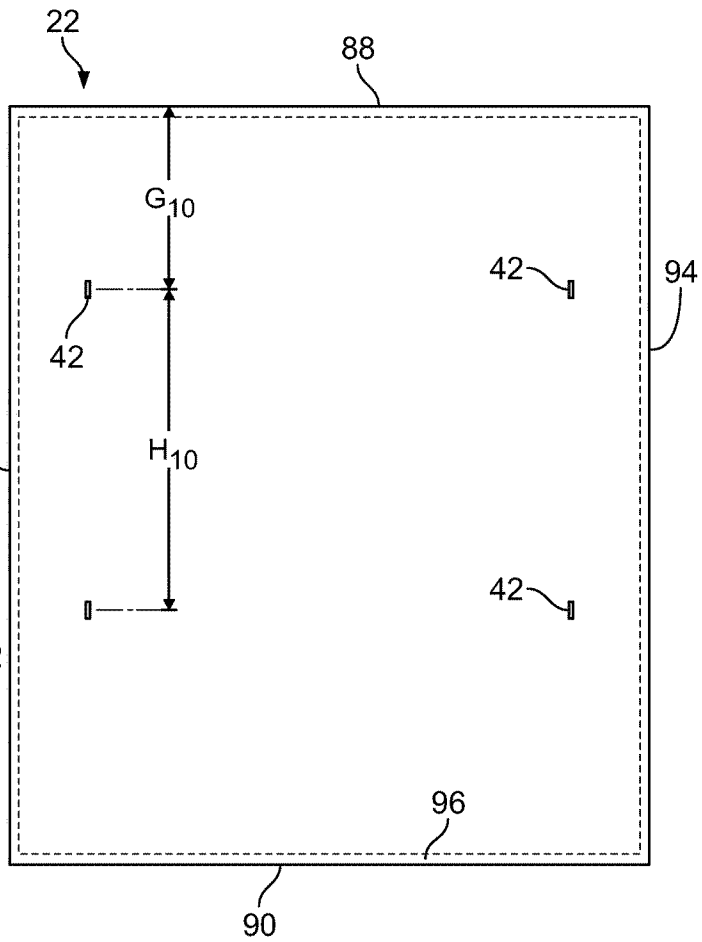
FIG. 11 is a top view of the blanket of FIG. 10.
Figure 10:
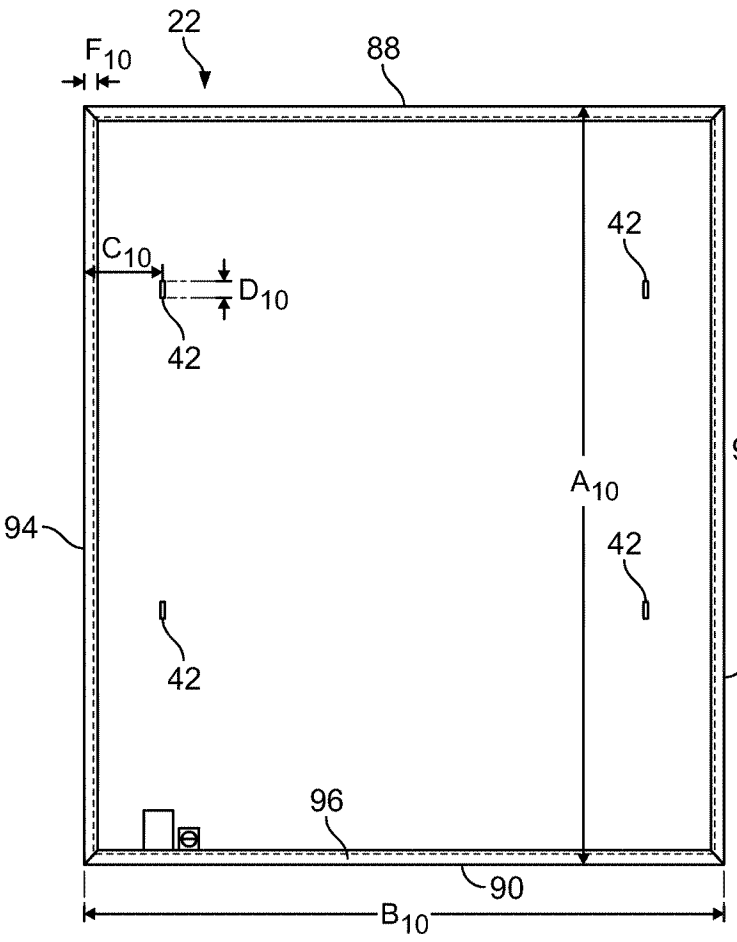
FIG. 10 is a bottom view of a blanket of the sheet system of FIG. 1.

FIG. 10 is a bottom view of the blanket 22. FIG. 11 is a top view of the blanket 22. The blanket 22 can have a head edge 88, a foot edge 90 opposite the head edge 88, a first side edge 92, and a second side edge 94 opposite the first side edge 92. A hem 96 can be sewn on all sides around the head edge 88, the foot edge 90, the first side edge 92, and the second side edge 94. In some embodiments, the blanket 22 can include a fleece material. In other embodiments, the blanket 22 can include one or more other materials suitable for the application. The blanket 22 can be sized such that, in some embodiments, it is configured to interconnected and fit suitably with the fitted sheet system 18 and the second sheet 20 as further explained herein. In some embodiments, suitable sizes for various features of the blanket 22 are described in TABLE 3, below. Corresponding dimensions are illustrated with respect to reference characters $A_{10}$-$H_{10}$ in FIGS. 10 and 11.

TABLE 3

| REF NO. | DESCRIPTION | Embodiment 1 (inches) | Embodiment 2 (inches) | Embodiment 3 (inches) |
|---|---|---|---|---|
| $A_{10}$ | length | 86 +/− ½" | 86 +/− ½" | 91 +/− ½" |
| $B_{10}$ | width | 60 +/− ½" | 76 +/− ½" | 82 +/− ½" |
| $C_{10}$ | buttonhole distance from edge | 4 +/− ⅛" | 4 +/− ⅛" | 4 +/− ⅛" |
| $D_{10}$ | buttonhole length | 1.13 +/− 1/16" | 1.13 +/− 1/16" | 1.13 +/− 1/16" |
| $F_{10}$ | hem (all sides) | 1 +/− ⅛" | 1 +/− ⅛" | 1 +/− ⅛" |
| $G_{10}$ | center of buttonhole from top | 21 +/− ⅛" | 21 +/− ⅛" | 21 +/− ⅛" |
| $H_{10}$ | distance between buttonholes, center to center | 26 +/− ¼" | 26 +/− ¼" | 26 +/− ¼" |

Figure 12:
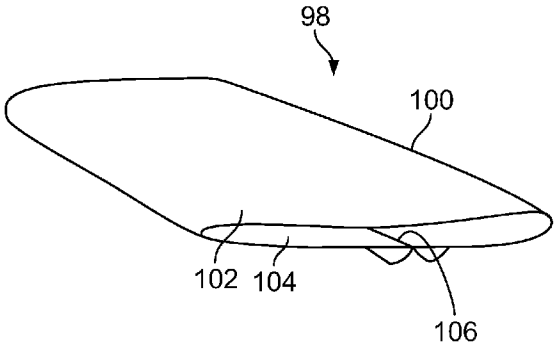
FIG. 12 is a perspective view of a reinforcement piece.

FIG. 12 is a perspective view of a reinforcement piece 98. The reinforcement piece 98 can include fabric 100 folded to first and second layers 102 and 104 and sewn at a seam 106. In some embodiments, the reinforcement piece 98 can be formed of twill tape, for example having a width of about 1.5 inches in width. The reinforcement piece 98 can be used to provide reinforcing support to other features of the sheet system 12 (shown in FIGS. 1 and 2), such as the button systems 36 (shown in FIGS. 1, 3, 4, 14) and the button-receiving slits 42 (shown in FIGS. 1, 8-11, 13).

Figure 13:
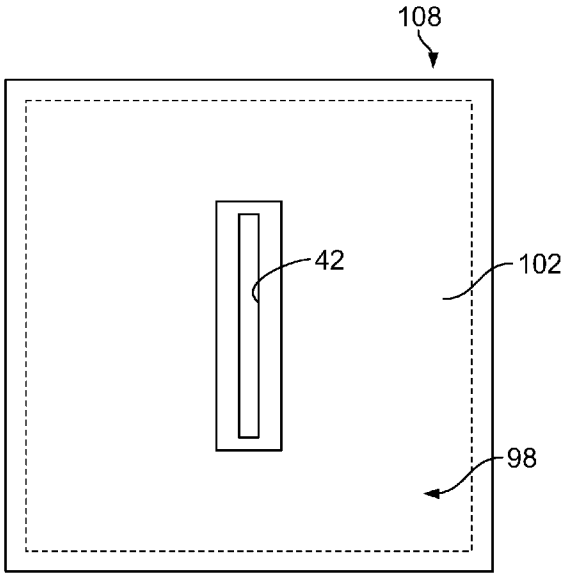
FIG. 13 is a side view of a slitted reinforcement piece.

FIG. 13 is a side view of a slitted reinforcement piece 108. The slitted reinforcement piece 108 can be formed from the reinforcement piece 98 (shown in FIG. 13) and by adding the button-receiving slit 42 therein. In some embodiments, the button-receiving slit 42 can have a length of about 1.25 inches. In some embodiments, the button-receiving slit 42 can have a length of between about 1 inch and about 1.5 inches. In some embodiments, the slitted reinforcement piece 108 can have dimensions of about 1.5 inches by about 2.25 inches. In some embodiments, the slitted reinforcement piece 108 can be sewn to the second sheet 20 (shown in FIGS. 1, 2, 8, 9) to reinforce the button-receiving slits 42 to improve strength of the second sheet 20 when engaged with the button systems 36 (shown in FIGS. 1, 3, 4, 14). In some embodiments, the slitted reinforcement piece 108 can be sewn to the blanket 22 (shown in FIGS. 1, 10, 11) to reinforce the button-receiving slits 42 to improve strength of the second sheet 20 when engaged with the button systems 36 (shown in FIGS. 1, 3, 4, 14).

Figure 14:
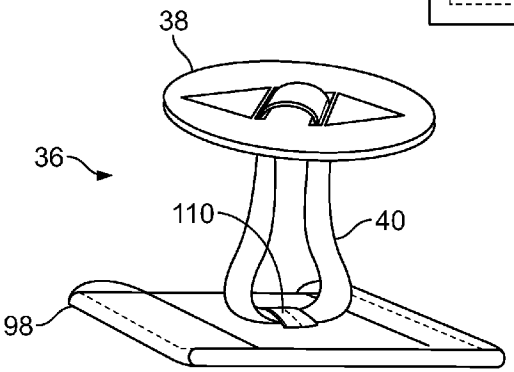
FIG. 14 is a perspective view of a button system.

FIG. 14 is a perspective view of the button system 36. In some embodiments, the button system 36 can be formed from the button 38 being connected via the strap 40 to one of the reinforcement pieces 98. In some embodiments, the strap 40 can be connected to the reinforcement piece 98 by a fastener 110, such as stitching. The strap 40 can be a length of elastic material extending from the reinforcement piece 98 to the buttons 38 to support the button 38 at a position spaced from the reinforcement piece 98. In some embodiments, the reinforcement piece 98 with the attached strap 40 and button 38 can be sewn to the fitted sheet 24 (shown in FIGS. 1-4) to connect the strap 40 and the button 30 to the fitted sheet 24 and the fitted sheet system 18. The reinforcement piece 98 can be sewn to an inner surface of the fitted sheet 24 with the strap 40 extending through a hole through the fitted sheet 24 and the button positioned on an outside of the fitted sheet 24. In some embodiments, such as embodiments in which the reinforcement piece 98 is formed of twill tape, the reinforcement piece 98 can be adhered to the inner surface of the fitted sheet 24 without requiring additional stitching to the fitted sheet 24.

In some embodiments the strap 40 can have a length configured to allow the button 38 to extend away from the fitted sheet 24 to allow space for movement of the second sheet 20 and/or the blanket 22 when attached to the button system 36. In some embodiments, the strap 40 can have a length between about 1 inch and about 2 inches. In some embodiments, the strap can have a length of about 1.5 inches. The strap 40 can be connected to a portion of the button 38 that is suitably strong to support forces applied to the button 38 by pulling on the second sheet 20 and/or the blanket 22. In some embodiments, the button 38 can be convex on both its top and bottom surfaces such that the button 38 it thickest in its middle section and thinner toward its perimeter. The button can have a diameter of about 1⅜ inch.

A number of embodiments of the invention have been described. Nevertheless, it will be understood that various modifications may be made without departing from the spirit and scope of the invention. For example, some embodiments may include certain features (such one or more as breakaway straps) but not all features disclosed (such as a blanket with button-receiving slits). Additionally, some embodiments may include dimensions of some features in Tables 1, 2, and/or 3 but may modify dimensions of other features or may omit such features entirely. Accordingly, other embodiments are within the scope of the following claims.

What is claimed is:

1. A fitted sheet system for use on a bed, the fitted sheet system comprising:

a fitted sheet comprising a top portion, a head portion, foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area; and a breakaway strap system comprising a first breakaway strap comprising a first length of elastic material reconnectably attached to a second length of substantially non-elastic material and extending from the first side portion to one of the head portion or the foot portion and configured to reconnectably detach in response to force pulling on the first breakaway strap, wherein the first length of elastic material is longer than the second length of substantially non-elastic material such that the first breakaway strap detaches the first length of elastic material from the second length of substantially non-elastic material at a location proximate the first side portion of the fitted sheet.

2. The fitted sheet system of claim 1, wherein the first breakaway strap extends to the head portion and the breakaway strap system further comprises:

a second breakaway strap extending from the second side portion to the head portion and configured to reconnectably detach in response to force pulling on the second breakaway strap;

a third breakaway strap extending from the first side portion to the foot portion and configured to reconnectably detach in response to force pulling on the third breakaway strap; and a fourth breakaway strap extending from the second side portion to the foot portion and configured to reconnectably detach in response to force pulling on the second breakaway strap.

3. The fitted sheet system of claim 2, wherein the first and second breakaway straps connected to the head portion are longer than the third and fourth breakaway straps connected to the foot portion and wherein each of the first, second, third, and fourth breakaway straps detach at locations proximate one of the first and second side portions.

4. The fitted sheet system of claim 1, wherein the second length of substantially non-elastic material comprises twill material extending from the first side portion to a first fastener that allows for breakaway attachment of the first length to the second length.

5. The fitted sheet system of claim 1, wherein the first length of elastic material has a first end sewn to the head portion and a second end connected to a first fastener, wherein the second length of substantially non-elastic material is sewn to the first side portion and connected to a second fastener configured to releasably mate with the first fastener at the location proximate the first side portion of the fitted sheet.

6. The fitted sheet system of claim 1, and further comprising:

at least one first button connected to a first reinforced section of the first side portion by a first elastic material at a first location of the first side portion spaced from a first edge of the first side portion; and at least one second button connected to a second reinforced section of the second side portion by a second elastic material at a second location of the second side portion spaced from a second edge of the second side portion.

7. A fitted sheet system for use on a bed, the fitted sheet system comprising:

a fitted sheet comprising a top portion, a head portion, a foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area; and a breakaway strap system comprising a first breakaway strap extending from the first side portion to one of the head portion or the foot portion and configured to reconnectably detach in response to force pulling on the first breakaway strap, wherein the first breakaway strap comprises a reconnectable snap that detaches in response to a tensile force being applied to the first breakaway strap exceeding a first threshold and that does not detach in response to a tensile force being applied to the first breakaway strap that is less that the first threshold, wherein the first breakaway strap has a first elastic strap portion that is longer than a second substantially non-elastic strap portion, wherein the second substantially non-elastic strap portion is connected at the first side portion of the fitted sheet such that the first breakaway strap detaches the first elastic strap portion from the second substantially non-elastic strap portion at a location proximate the first side portion of the fitted sheet.

8. A sheet system comprising:

a fitted sheet system comprising:

a fitted sheet comprising a top portion, a head portion, foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area;

a breakaway strap system comprising a first breakaway strap extending from the first side portion to one of the head portion or the foot portion and configured to reconnectably detach in response to force pulling on the first breakaway strap, wherein the first breakaway strap has a first elastic strap portion that is longer than a second substantially non-elastic strap portion, wherein the second substantially non-elastic strap portion is connected at the first side portion of the fitted sheet such that the first breakaway strap detaches the first elastic strap portion from the second substantially non-elastic strap portion at a location proximate the first side portion of the fitted sheet; and a plurality of fasteners with at least one fastener positioned on each of the first and second side portions of the fitted sheet; and a second sheet having a head end, a foot end, a first side edge, and a second side edge, wherein the foot end is a fitted end configured to be fitted along a mattress and the head end is an opened end and wherein the second sheet is configured to be attached to the plurality of fasteners.

9. The sheet system of claim 8, wherein the second sheet comprises elastic material extending along a portion of the first side edge near the foot end, along a portion of the second side edge near the foot end, and along a foot edge.

10. The sheet system of claim 9, wherein the second sheet comprises substantially no elastic material extending along a portion of the first side edge near the head end, along a portion of the second side edge near the head end, and along a head edge.

11. The sheet system of claim 8, wherein the second sheet comprises reinforcement pieces defining reinforced button-receiving slits positioned near the first and second side edges, and wherein the plurality of fasteners comprise:

a first plurality of buttons connected to first reinforced sections of the first side portion by a first plurality of elastic materials at locations of the first side portion spaced from a first edge of the first side portion; and a second plurality of buttons connected to second reinforced sections of the second side portion by a second plurality of elastic materials at locations of the second side portion spaced from a second edge of the second side portion.

12. The sheet system of claim 11, wherein the reinforced button-receiving slits comprise a first reinforced button-receiving slit near the first side edge positioned between 50.57 and 51.07 inches from a second reinforced button-receiving slit near the second side edge, and a third reinforced button-receiving slit near the first side edge positioned between 50.57 and 51.07 inches from a fourth reinforced button-receiving slit near the second side edge.

13. The sheet system of claim 8, wherein the fitted sheet has fitted elastic material around its entire edge including the head portion, the first side portion, the foot portion, and the second side portion, and wherein the second sheet has fitted elastic material along a fitted edge of the foot end of the second sheet.

14. The sheet system of claim 8, wherein the fitted sheet system has dimensions selected from a group consisting of Embodiment 1, Embodiment 2, and Embodiment 3 of the following Table 1:

| REF NO. | DESCRIPTION | Embodiment 1 (inches) | Embodiment 2 (inches) | Embodiment 3 (inches) |
|---|---|---|---|---|
| $A_4$ | length | 78 +/− ½" | 78 +/− ½" | 83.2 +/− ½" |
| $B_4$ | width | 39.52 +/− ½" | 56.16 +/− ½" | 62.4 +/− ½" |
| $C_4$ | pocket depth | 12.48 +/− ¼" | 12.48 +/− ¼" | 12.48 +/− ¼" |
| $D_4$ | center of button from top | 21.84 +/− ¼" | 21.84 +/− ¼" | 21.84 +/− ¼" |
| $E_4$ | length: button to button | 26 +/− ¼" | 26 +/− ¼" | 26 +/− ¼" |
| $F_4$ | top elastic length finished | 15 +/− ¼" | 15 +/− ¼" | 15 +/− ¼" |
| $G_4$ | bottom elastic length finished | 9 +/− ¼" | 9 +/− ¼" | 9 +/− ¼" |
| $H_4$ | bottom tab distance from bottom seam | 10.4 +/− ¼" | 10.4 +/− ¼" | 10.4 +/− ¼" |
| $I_4$ | tab length with male snap | 1.25 +/− ¼" | 1.25 +/− ¼" | 1.25 +/− ¼" |
| $J_4$ | center of tab from top seam | 17.68 +/− ¼" | 17.68 +/− ¼" | 17.68 +/− ¼" |
| $K_4$ | center of button from side edges | 8.32 +/− ¼" | 8.32 +/− ¼" | 8.32 +/− ¼" |
| $L_4$ | top elastic distance from seam | 16.64 +/− ¼" | 16.64 +/− ¼" | 16.64 +/− ¼" |

-continued

| REF NO. | DESCRIPTION | Embodiment 1 (inches) | Embodiment 2 (inches) | Embodiment 3 (inches) |
|---|---|---|---|---|
| $M_4$ | bottom elastic distance from seam | 10.4 +/− ¼" | 10.4 +/− ¼" | 10.4 +/− ¼" |
| $N_4$ | width: button to button | 47.84 +/− ¼" | 64.48 +/− ¼" | 70.72 +/− ¼" |

and the second sheet has dimensions selected from a group consisting of Embodiment 1, Embodiment 2, and Embodiment 3 of the following Table 2:

| REF NO. | DESCRIPTION | Embodiment 1 (inches) | Embodiment 2 (inches) | Embodiment 3 (inches) |
|---|---|---|---|---|
| $A_8$ | length | 80.08 +/− ½" | 80.08 +/− ½" | 85.28 +/− ½" |
| $B_8$ | width at top | 60.32 +/− ½" | 76.96 +/− ½" | 83.2 +/− ½" |
| $C_8$ | width at bottom | 39.52 | 56.16 +/− ½" | 62.4 +/− ½" |
| $D_8$ | pocket depth | 10.4 +/− ¼" | 10.4 +/− ¼" | 10.4 +/− ¼" |
| $E_8$ | top hem | 4 +/− ¼" | 4 +/− ¼" | 4 +/− ¼" |
| $F_8$ | side hem | 0.5 +/− ⅛" | 0.5 +/− ⅛" | 0.5 +/− ⅛" |
| $G_8$ | top of sheet to center of buttonhole | 21.84 +/− ¼" | 21.84 +/− ¼" | 21.84 +/− ¼" |
| $H_8$ | center of buttonhole to center of buttonhole | 26 +/− ¼" | 26 +/− ¼" | 26 +/− ¼" |
| $I_8$ | side edge of sheet to bottom of reinforcement | 4 +/− ¼" | 4 +/− ¼" | 4 +/− ¼" |
| $J_8$ | elastic stop from seam | 10 +/− ¼" | 10 +/− ¼" | 10 +/− ¼" |
| $K_8$ | width: center of buttonhole to center of buttonhole | 50.82 +/− ¼" | 67.46 +/− ¼" | 73.70 +/− ¼" |

15. The sheet system of claim 8, wherein the fitted sheet system comprises no fastener connecting the foot portion of the fitted sheet to the foot end of the second sheet and wherein the fitted end of the second sheet is configured to hold the second sheet in place on a bed when the plurality of fasteners are attached.

16. The sheet system of claim 11, wherein the reinforcement pieces are sewn on a bottom side of the second sheet.

17. A sheet system comprising:

a fitted sheet comprising a top portion, a head portion, foot portion, a first side portion, and a second side portion, such that the top portion is connected to each of the head portion, the foot portion, the first side portion, and the second side portion with the head portion positioned opposite the foot portion and the first side portion positioned opposite the second side portion so as to define a mattress receiving area;

a first reinforcement positioned at the first side portion to define a first reinforced section;

a second reinforcement positioned at the second side portion to define a second reinforced section;

at least one first fastener connected to the first reinforced section of the first side portion by a first elastic material at a first location of the first side portion spaced from a first edge of the first side portion;

at least one second fastener connected to the second reinforced section of the second side portion by a second of elastic material at a second location of the second side portion spaced from a second edge of the second side portion;

a breakaway strap extending from the first side portion to one of the head portion or the foot portion and configured to reconnectably detach in response to force pulling on the breakaway strap, wherein the breakaway strap has a first elastic strap portion that is longer than a second substantially non-elastic strap portion, wherein the second substantially non-elastic strap portion is connected at the first side portion of the fitted sheet such that the breakaway strap detaches the first elastic strap portion from the second substantially non-elastic strap portion at a location proximate the first side portion of the fitted sheet; and a second sheet having a head end, a foot end, a first side edge, and a second side edge, wherein the foot end is a fitted end configured to be fitted along a mattress and the head end is an opened end and wherein the second sheet is configured to be attached to the first and second fasteners.

18. The sheet system of claim 17, and further comprising:

a blanket having a blanket head end, a blanket foot end, a blanket first side edge, and a blanket second side edge, wherein blanket is configured to be attached to the first and second fasteners.

19. The sheet system of claim 17, wherein the first reinforcement comprises a first reinforcement fabric piece, wherein the second reinforcement comprises a second reinforcement fabric piece, wherein the first fastener comprises a first button connected to the first reinforced section of the first side portion by the first elastic material extending from the first side portion to the first button and the second fastener comprises a second button connected to the second reinforced section of the second side portion by the second elastic material extending from the second side portion to the second button.

20. The sheet system of claim 17, wherein the first and second reinforcements are sewn on a bottom side of the fitted.

* * * * *